US010081413B2

(12) United States Patent
Lee et al.

(10) Patent No.: US 10,081,413 B2
(45) Date of Patent: Sep. 25, 2018

(54) CONTAINER SHIP AND LAYOUT STRUCTURE THEREOF

(71) Applicant: DAEWOO SHIPBUILDING & MARINE ENGINEERING CO., LTD., Seoul (KR)

(72) Inventors: Joon Chae Lee, Seoul (KR); Dong Chan Kim, Goyang-si (KR); In Don Jung, Geoje-si (KR); Hyeong Won Kim, Goyang-si (KR); Chang Ho Je, Geoje-si (KR)

(73) Assignee: DAEWOO SHIPBUILDING & MARINE ENGINEERING CO., LTD., Seoul (KR)

( * ) Notice: Subject to any disclaimer, the term of this patent is extended or adjusted under 35 U.S.C. 154(b) by 0 days.

(21) Appl. No.: 15/505,595

(22) PCT Filed: Apr. 29, 2015

(86) PCT No.: PCT/KR2015/004283

§ 371 (c)(1),
(2) Date: Feb. 21, 2017

(87) PCT Pub. No.: WO2016/027961

PCT Pub. Date: Feb. 25, 2016

(65) Prior Publication Data

US 2017/0267318 A1 Sep. 21, 2017

(30) Foreign Application Priority Data

Aug. 18, 2014 (KR) ..... 10-2014-0107066

(51) Int. Cl.
*B63B 25/08* (2006.01)
*B63B 25/16* (2006.01)
(Continued)

(52) U.S. Cl.
CPC ..... *B63B 25/16* (2013.01); *B63B 11/00* (2013.01); *B63B 11/02* (2013.01); *B63H 21/38* (2013.01)

(58) Field of Classification Search
CPC ..... B63B 11/00; B63B 11/02; B63B 11/04; B63B 25/00; B63B 25/04; B63B 25/08;
(Continued)

(56) References Cited

U.S. PATENT DOCUMENTS 3,848,559 A * 11/1974 Tarossi ..... B63B 25/16 114/74 A
2012/0238161 A1* 9/2012 Lee ..... B63B 25/16 440/88 F
2012/0244762 A1* 9/2012 Lee ..... B63B 25/16 440/88 F

FOREIGN PATENT DOCUMENTS

DE 202014000942 U1 5/2014
JP 2008-126829 A 6/2008
(Continued)

OTHER PUBLICATIONS

International Search Report dated Aug. 3, 2015 of PCT/KR2015/004283 which is the parent application and its English translation—4 pages.

(Continued)

*Primary Examiner* — Daniel V Venne
(74) *Attorney, Agent, or Firm* — Knobbe Martens Olson & Bear LLP

(57) ABSTRACT

A container ship and a layout structure thereof are disclosed. In the layout structure of the container ship of the present invention, an engine room, in which a propulsion engine receiving LNG as fuel is provided, is disposed under a main deck at the stern of the container ship, an LNG storage tank storing the LNG is disposed in a cargo hold adjacent to the engine room, a fuel supply part for receiving the LNG from the LNG storage tank and supplying the LNG to the propulsion engine is disposed right above the LNG storage tank
(Continued)

inside the cargo hold, and a void space isolating the LNG storage tank and the fuel supply part from each other is disposed therebetween.

12 Claims, 2 Drawing Sheets

(51) Int. Cl.
*B63H 21/38* (2006.01)
*B63B 11/00* (2006.01)
*B63B 11/02* (2006.01)

(58) Field of Classification Search
CPC ..... B63B 25/12; B63B 25/14; B63B 25/16; B63B 2025/00; B63B 2025/08; B63B 2025/085; B63B 2025/087; B63B 2057/00; B63B 2770/00; B63H 21/00; B63H 21/38
USPC ..... 114/72, 73, 74 R, 74 T, 74 A, 78; 440/88 R, 88 F
See application file for complete search history.

(56) References Cited

FOREIGN PATENT DOCUMENTS

| | | | |
|---|---|---|---|
| KR | 20-0437039 | Y1 | 10/2007 |
| KR | 10-2009-0006317 | A | 1/2009 |
| KR | 10-2011-0041941 | A | 4/2011 |
| KR | 10-2011-0047414 | A | 5/2011 |
| KR | 10-2012-0133360 | A | 12/2012 |
| KR | 10-2013-0105058 | A | 9/2013 |
| KR | 10-2014-0058479 | A | 5/2014 |

OTHER PUBLICATIONS

Extended European Search Report of corresponding European Patent Application No. 15834063.8—10 pages, (dated Mar. 1, 2018).

Osberg, "Gas engine propulsion in ships: Safety considerations", Det Norske Veritas AS—31 pages, (Jun. 2008).

* cited by examiner

CONTAINER SHIP AND LAYOUT STRUCTURE THEREOF

TECHNICAL FIELD

The present invention relates to a container ship and a layout structure of the same and, more particularly, to a container ship which includes an engine room disposed under a stern main deck to accommodate a propulsion engine fueled by LNG, an LNG storage tank disposed in a cargo hold adjacent to the engine room to store LNG, a fuel supply unit disposed directly above the LNG storage tank in the cargo hold to supply LNG from the LNG storage tank to the propulsion engine, and a void space defined between the LNG storage tank and the fuel supply unit to isolate the LNG storage tank from the fuel supply unit, and a layout structure of the same.

BACKGROUND ART

Recently, consumption of liquefied gas such as liquefied natural gas (LNG) and liquefied petroleum gas (LPG) has been rapidly increasing worldwide.

In particular, liquefied natural gas (hereinafter, "LNG") is an eco-friendly fuel with low emission of air pollutants during combustion and is increasingly used in various fields.

LNG is a colorless transparent liquid which can be obtained by cooling natural gas containing methane as a main component to about −162° C., and has a volume of about 1/600 that of natural gas. Thus, liquefaction of natural gas into LNG enables very efficient transportation of natural gas. For example, LNG carriers are used to transport (carry) LNG by sea.

As regulatory standards for ships in international organizations and various countries are becoming increasingly stringent, there is also a growing interest in eco-friendly, highly efficient fuels for ships. As a part of this, engines such as a dual fuel diesel electric (DFDE) engine, which can be fueled by gas generated by natural or forced evaporation of LNG have been developed and applied to ships.

Such a ship using LNG as a fuel is referred to as an LFS (LNG-fueled ship). Along with strengthening emission standards for ships and stabilization of LNG prices, LFSs are expected to become more active in construction and operation.

DISCLOSURE

Technical Problem

It is an aspect of the present invention to provide a layout structure for a container ship provided with an engine fueled by LNG, which enables effective fuel supply and efficient space utilization, and a ship employing the same.

Technical Solution

In accordance with one aspect of the present invention, there is provided a layout structure for a container ship, including:

an engine room disposed under a stern main deck of the container ship to accommodate a propulsion engine fueled by LNG;

an LNG storage tank disposed in a cargo hold adjacent to the engine room to store LNG;

a fuel supply unit disposed directly above the LNG storage tank in the cargo hold to supply LNG from the LNG storage tank to the propulsion engine; and a void space defined between the LNG storage tank and the fuel supply unit to isolate the LNG storage tank from the fuel supply unit.

Preferably, an accommodation space is disposed on the main deck under which the engine room is disposed, wherein the accommodation space is provided with a pipe for discharging exhaust gas generated in the engine room.

Preferably, a bunkering line for supplying LNG from the outside of the ship to the LNG storage tank is disposed between the accommodation space and the fuel supply unit.

Preferably, the container ship is a medium or large container ship provided with a single accommodation space and having a capacity of 5,000 TEU (twenty-foot equivalent unit) or more.

Preferably, the cargo hold adjacent to the engine room is divided into a space for accommodating the LNG storage tank and a space for accommodating containers.

Preferably, the LNG storage tank is an independent B-type tank.

Preferably, a double bulkhead is disposed between the space for accommodating the LNG storage tank and the space for accommodating containers, wherein the double bulkhead is provided with a gas detector detecting leakage of LNG.

Preferably, a cargo loading deck on which containers are loaded is disposed on the main deck above the fuel supply unit.

In accordance with another aspect of the present invention, there is provided a container ship, including: an engine room disposed under a stern main deck to accommodate a propulsion engine fueled by LNG;

an LNG storage tank disposed in a cargo hold adjacent to the engine room to store LNG;

a fuel supply unit disposed directly above the LNG storage tank in the cargo hold to supply LNG from the LNG storage tank to the propulsion engine; and a void space defined between the LNG storage tank and the fuel supply unit to isolate the LNG storage tank from the fuel supply unit.

Preferably, an accommodation space is disposed on the main deck under which the engine room is disposed; a bunkering line for supplying LNG from the outside of the ship to the LNG storage tank is disposed between the accommodation space and the fuel supply unit; and a cargo loading deck on which containers are loaded is disposed on the main deck above the fuel supply unit.

Advantageous Effects

In a layout structure for a container ship according to the present invention, an engine room is disposed under a stern main deck; an LNG storage tank is disposed in a cargo hold adjacent to the engine room; and a void space and a fuel supply unit are disposed above the LNG storage tank.

With the layout structure wherein the LNG storage tank, the fuel supply unit, and the void space are disposed in the cargo hold adjacent to the engine room under the stern deck, the container ship can shorten the fuel transfer distance, thereby providing effective fuel supply.

In addition, according to the present invention, the cargo hold is divided such that cargo can be loaded in a space other than a space for accommodating the storage tank and the like, and a cargo loading deck is disposed above the fuel supply unit, thereby maximizing a cargo loading space and increasing space utilization of the ship. Further, a bunkering line is disposed between the accommodation space and the fuel supply unit to minimize the length of a pipe for bunkering of LNG while optimizing the use of equipment.

EMBODIMENTS

Figure 1:
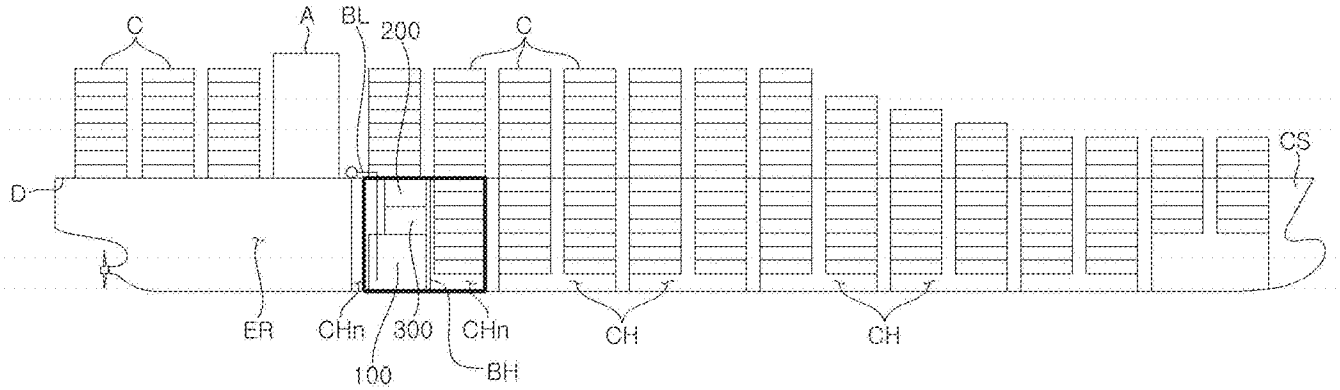
FIG. 1 is a schematic side sectional view of a container ship employing a layout structure according to one embodiment of the present invention.

The above and other aspects, features, and advantages of the present invention will become apparent from the detailed description of the following embodiments in conjunction with the accompanying drawings.

Hereinafter, exemplary embodiments of the present invention will be described in detail with reference to the accompanying drawings. It should be noted that like components will be denoted by like reference numerals throughout the specification and the accompanying drawings.

Figure 2:
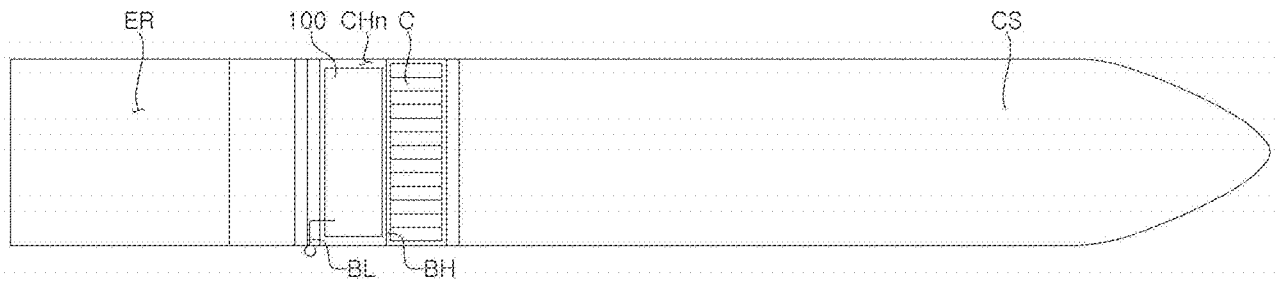
FIG. 2 is a schematic plan view of the container ship of FIG. 1.

FIG. 1 is a schematic side sectional view of a container ship CS employing a layout structure according to one embodiment of the present invention and FIG. 2 is a schematic plan view of the same.

Referring to FIGS. 1 and 2, in a layout structure for a container ship CS according to this embodiment, an engine room ER is disposed under a stern main deck D of the container ship CS to accommodate a propulsion engine (not shown) fueled by LNG; an LNG storage tank 100 is disposed in a cargo hold CHn adjacent to the engine room ER to store LNG; a fuel supply unit 200 is disposed directly above the LNG storage tank 100 in the cargo hold CH to supply LNG from the LNG storage tank 100 to the propulsion engine; and a void space 300 is defined between the LNG storage tank 100 and the fuel supply unit 200 to isolate the LNG storage tank 100 from the fuel supply unit 200.

The fuel supply unit 200 compresses and heats a gaseous fuel to supply the fuel according to fuel supply conditions of the engine. If the distance from the engine room ER to the fuel supply unit 200 is increased, the fuel can be delivered in a manner incompatible with the fuel supply conditions and in a non-controlled manner in the process of delivering the gaseous fuel through a pipe.

In addition, if the distance from the LNG storage tank 100 to the fuel supply unit 200 is increased, a pipe for transferring extremely low temperature LNG becomes long, causing increase in installation costs and reduction in safety of the ship due to breakage of the pipe or the like.

Thus, according to this embodiment, the LNG storage tank 100 and the fuel supply unit 200 are disposed in a cargo hold CHn closest to the engine room ER so as to shorten the transfer distance of LNG and to minimize the length of the pipe for supplying the fuel.

The void space 300 serves to isolate the LNG storage tank 100 from the fuel supply unit 200 to minimize the influence therebetween.

An accommodation space A is disposed on the main deck D under which the engine room ER is disposed. The accommodation space A may be provided with a pipe (not shown) for discharging exhaust gas generated in the engine room ER, and a bunkering line BL for supplying LNG from the outside of the ship to the LNG storage tank 100 may be disposed between the accommodation space A and the fuel supply unit 200.

The container ship CS according to this embodiment is a liquefied natural gas-fueled ship (LFS) that operates using LNG as a propulsion fuel and may be a post-Panamax container ship which has a capacity of 5,000 TEU (twenty-foot equivalent unit) or more and is provided with a single accommodation space A, for example, a medium or large container ship CS having a capacity of 8,000 TEU.

In order to meet the fuel needs of such a medium or large ship, it may be desirable that the LNG storage tank 100 disposed in the cargo hold CH be an independent B-type tank.

A C-type tank, which is a pressurized vessel, is characterized in that manufacturing costs and tank volume sharply increase with increasing size of the tank, and such a pressurized vessel has a technical limitation in capacity increase. In contrast, the independent B-type tank can withstand a pressure from normal pressure to medium pressure and has an advantage in that manufacturing costs and tank volume do not sharply increase even with increasing size of the tank in order to satisfy the fuel needs of a medium to large ship, whereby the tank can be easily enlarged.

For example, as the propulsion engine disposed in the engine room ER according to this embodiment, a main electric gas injection (ME-GI) engine or a dual fuel (DF) engine fueled by LNG may be used.

The fuel supply unit 200 may be provided with devices (not shown) such as a compressor or a pump for compressing a fuel to a pressure sufficient to drive the engine, a vaporizer for regasifying LNG, a heater, and the like so as to supply the fuel from the LNG storage tank 100 to the propulsion engine.

A fan room (not shown) may be disposed in the accommodation space A, such that a vent line (not shown) from the fuel supply unit 200 can extend to the fan room in the accommodation space A.

According to this embodiment, the cargo hold CHn provided with the LNG storage tank 100, which is adjacent to the engine room ER, is divided into a space for accommodating the LNG storage tank 100 and a space for accommodating containers C, such that the containers C can be loaded in a space other than a space in which the LNG storage tank 100, the fuel supply unit 200, the void space 300, and the like are disposed.

Here, division of the cargo hold CHn provided with the LNG storage tank 100 into the space accommodating the LNG storage tank and the space accommodating containers is achieved by installation of a double bulkhead BH, and a gas detector (not shown) may be disposed between bulkhead units and between the bulkhead and the LNG storage tank 100 to detect leakage of LNG. In addition, a fire barrier may be disposed between the space for accommodating containers and the double bulkhead BH to prevent sparks generated outside the double bulkhead from entering the inside of the double bulkhead, where the LNG storage tank 100 is disposed, thereby securing safety.

Further, a cargo loading deck (not shown) on which containers C are loaded is disposed on the main deck D above the fuel supply unit 200. In this way, by allowing cargos to be loaded in the cargo hold CHn in which the LNG storage tank 100 is disposed and on the deck above the fuel supply unit 200, it is possible to maximize a cargo loading space and to increase space utilization of the ship.

Although some embodiments have been described herein, it should be understood that these embodiments are provided for illustration only and are not to be construed in any way as limiting the present invention, and that various modifications, changes, alterations, and equivalent embodiments can be made by those skilled in the art without departing from the spirit and scope of the invention.

The invention claimed is:

1. A layout structure of a container ship, comprising:

an engine room disposed under a stern main deck of the container ship and comprising a propulsion engine fueled by liquefied natural gas (LNG);

an LNG storage tank disposed in a cargo hold and configured to store LNG;

a fuel supply unit disposed in the cargo hold and directly above the LNG storage tank, the fuel supply unit being configured to supply LNG from the LNG storage tank to the propulsion engine;

a void space between the LNG storage tank and the fuel supply unit;

an accommodation space disposed on the stern main deck and over the engine room, a pipe provided in the accommodation space and configured to discharging exhaust gas from the engine room; and a bunkering line for supplying LNG from outside the container ship to the LNG storage tank, wherein the bunkering line is disposed between the accommodation space and the fuel supply unit.

2. The layout structure according to claim 1, wherein the container ship is a container ship provided with a single accommodation space and having a capacity of 5,000 twenty-foot equivalent unit (TEU) or more.

3. The layout structure according to claim 1, wherein a cargo loading deck for loading containers thereon is disposed on the stern main deck and above the fuel supply unit.

4. The layout structure of claim 1, wherein the cargo hold is the closest to the engine room among a plurality of cargo holds of the container ship.

5. The layout structure of claim 1, wherein the cargo hold is adjacent to the engine room.

6. A layout structure of a container ship, comprising:

an engine room disposed under a stern main deck of the container ship and comprising a propulsion engine fueled by liquefied natural gas (LNG);

an LNG storage tank disposed in a cargo hold and configured to store LNG;

a fuel supply unit disposed in the cargo hold and directly above the LNG storage tank, the fuel supply unit being configured to supply LNG from the LNG storage tank to the propulsion engine;

a void space between the LNG storage tank and the fuel supply unit;

an accommodation space disposed on the stern main deck and over the engine room, a pipe provided in the accommodation space and configured to discharging exhaust gas from the engine room; and wherein the cargo hold is divided into a space for accommodating the LNG storage tank and a space for accommodating containers.

7. The layout structure according to claim 6, wherein a double bulkhead is disposed between the space for accommodating the LNG storage tank and the space for accommodating containers.

8. The layout structure of claim 6, wherein the cargo hold is the closest one to the engine room among a plurality of cargo holds of the container ship.

9. The layout structure of claim 6, wherein the cargo hold is adjacent to the engine room.

10. A container ship, comprising, a engine room disposed under a stern main deck of the container ship and comprising a propulsion engine fueled by liquefied natural gas (LNG);

an LNG storage tank disposed in a cargo hold and configured to store LNG;

a fuel supply unit disposed in the cargo hold and directly above the LNG storage tank, the fuel supply unit being configured to supply LNG from the LNG storage tank to the propulsion engine;

a void space between the LNG storage tank and the fuel supply unit;

an accommodation space disposed on the stern main deck and over the engine room;

a bunkering line for supplying LNG from outside the container ship to the LNG storage tank disposed between the accommodation space and the fuel supply unit; and a cargo loading deck for loading containers thereon disposed on the stem, main deck and above the fuel supply unit.

11. The container ship of claim 10, wherein the cargo hold is the closest one to the engine room among a plurality of cargo holds of the container ship.

12. The container ship of claim 10, wherein the cargo hold is adjacent to the engine room.

* * * * *